US011752544B2

(12) United States Patent
Yang et al.

(10) Patent No.: US 11,752,544 B2
(45) Date of Patent: Sep. 12, 2023

(54) CENTRIFUGAL CASTING

(71) Applicant: ROLLS-ROYCE PLC, London (GB)

(72) Inventors: Rui Yang, Shenyang (CN); Yuyou Cui, Shenyang (CN); Paul A Withey, Derby (GB); Nicholas Green, Bidford on Avon (GB); Feiyang Liu, Shenyang (CN)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 17/519,207

(22) Filed: Nov. 4, 2021

(65) Prior Publication Data

US 2022/0143685 A1 May 12, 2022

(30) Foreign Application Priority Data

Nov. 9, 2020 (GB) ..... 2017635

(51) Int. Cl.
*B22D 13/10* (2006.01)

(52) U.S. Cl.
CPC ..... *B22D 13/101* (2013.01)

(58) Field of Classification Search
CPC ..... B22D 13/101; B22D 13/00; B22D 13/04; B22D 13/102; B22D 13/107; B22D 13/12
See application file for complete search history.

(56) References Cited

U.S. PATENT DOCUMENTS 10,252,327 B2 4/2019 Foltz, IV et al.
2011/0198964 A1* 8/2011 Biederman ..... B22C 9/04 29/598
2012/0207611 A1 8/2012 Luckow et al.
2016/0221073 A1 8/2016 Foltz, IV et al.
2016/0332223 A1 11/2016 Henker et al.
2019/0046844 A1* 2/2019 Chao ..... A63B 53/0466

FOREIGN PATENT DOCUMENTS

CN 101564763 A * 10/2009
EP 2067547 A1 6/2009
GB 2290998 A 1/1996
GB 2290998 B 8/1997
JP 2002-331352 A 11/2002

OTHER PUBLICATIONS

Mar. 5, 2021 Search Report issued in British Patent Application No. 2017635.0.
John Campbell. Complete Casting Handbook: Metal Casting Processes, Metallurgy, Techniques and Design. Butterworth Heinemann, Elsevier, 2011, pp. 659-696.
"Titanium Aluminide". Wikipedia, URL: https://en.wikipedia.org/wiki/Titanium_aluminide, retrieved on Oct. 19, 2021.
Mar. 3, 2022 European Search Report issued in European Patent Application 21204623.9.

* cited by examiner

*Primary Examiner* — Kevin P Kerns
*Assistant Examiner* — Steven S Ha
(74) *Attorney, Agent, or Firm* — Oliff PLC

(57) ABSTRACT

A centrifugal casting apparatus comprising an upper portion into which molten material is poured, the upper portion having a central rotational axis about which the apparatus is rotated; at least one block runner is connected to the upper portion at the proximal end of the block runner and to at least one mould at the distal end of the block runner, the block runner being mounted substantially perpendicular to the axis of rotation; and wherein the moulds are oriented substantially parallel to the axis of rotation of the centrifugal casting apparatus.

11 Claims, 4 Drawing Sheets

CENTRIFUGAL CASTING

This specification is based upon and claims the benefit of priority from UK Patent Application Number GB 2017635.0 filed on 9 Nov. 2020, the entire contents of which are incorporated herein by reference.

BACKGROUND

Overview of the Disclosure

The present disclosure relates to an apparatus and method for casting a component.

In particular the apparatus and method relates to means of centrifugally casting complex products.

BACKGROUND OF THE DISCLOSURE

Casting is used in the production of many complex components. There are a number of different known casting techniques, with different techniques being used for different components. The determination of technique is dependent upon the complexity of the shape and the material being used for the cast component.

In turbine design, within gas turbine engines, there is a constant drive to look for improved materials for weight reduction and improved operating temperatures. One group of materials that are seen as having desirable properties for future turbine blades are titanium alloys. In particular there is a desirable category of titanium based aluminide (TiAl) alloys that possess many suitable properties. These alloys have the advantage that they have half the density of nickel based super alloys, so produce a significant weight saving. However, these alloys have a number of challenges which relate to the materials properties that affect it and make it difficult to develop a manufacturing process that takes advantage of their benefits. This is because the material is brittle at room temperature as well as being extremely reactive when molten.

Blades for gas turbine engines are typically produced using net shaped investment casting, which offers the advantage of being a relatively low-cost approach to manufacture. However, when using titanium aluminide alloys the lack of superheat prior to filling the mould results in the alloy solidifying before the mould is filled completely. To overcome this drawback, the alloy has to be poured quickly to prevent freezing; this, however, results in turbulence in the alloy. The effect of having turbulence in the cast material leads to porosity being frozen into the casting in two ways. Firstly, turbulence produced bubbles which are frozen into the material. Secondly, the solidification path is not controlled, which results in sub-surface solidification shrinkage. The porosity resulting from the casting process typically results in surface pits being present on the blade, even after the blade has been Hot Isostatically Pressed (HIP); this results in millimeter sized defects in the surface of the component. To overcome the problem of surface pitting the blades are made oversized, so that the defects, which are contained within the oversize portion, can be machined off to leave the final product. However, the downside of this is that it causes extra processing steps and waste material that increase the cost of the component.

Current methods for using titanium aluminide alloys include the use of oversized casting or forging. Casting has the disadvantage of requiring the use of induction skull melting or vacuum arc remelting, which results in little super heat, which is required to allow a good mould fill. Forging on the other hand has to be carried out at an elevated temperature and as such is expensive. Another option that is being explored is the use of additive manufacturing technologies. Additive manufacturing is expensive as it needs to be performed in an inert atmosphere to avoid any reaction with oxygen. Furthermore, any further machining after production of the component is difficult as the material is brittle and is best reduced to a minimum. EP 2067547 A2 discloses a method of using a centrifugal casting with the blades set in the radial direction. However, such a technique leads to turbulence induced porosity and a requirement to over-stock the blades.

SUMMARY OF THE DISCLOSURE

According to a first aspect there is provided a method of casting a component comprising: attaching a mould to a centrifugal casting apparatus, such that the mould is oriented substantially parallel to the axis of rotation of the centrifugal casting apparatus, and applying a molten feedstock through a block runner mounted substantially perpendicular to the axis of rotation to control and contain the turbulence within the molten feedstock.

The thinnest part of the mould may be oriented in a radial direction away from the axis of rotation.

The molten feedstock may be a titanium aluminide alloy material.

The mould may be pre-heated prior to the casting process.

The mould may be heated to a temperature between 400 and 900° C.

A thin investment shell may be placed within the mould.

The shell may be backed with a ceramic grit.

The centrifugal casting apparatus may be rotated at 200 to 400 rpm.

The mould may be mounted perpendicular to the block runner to prevent turbulence.

The mould may be configured to allow for a quiescent fill process.

The cast component may be a blade.

The blade may be a blade for a gas turbine engine.

According to a second aspect there is provided a centrifugal casting apparatus comprising an upper portion into which molten material is poured, the upper portion having a central rotational axis about which the apparatus is rotated; at least one block runner is connected to the upper portion at the proximal end of the block runner and to at least one mould at the distal end of the block runner, the block runner being mounted substantially perpendicular to the axis of rotation; and wherein the moulds are oriented substantially parallel to the axis of rotation of the centrifugal casting apparatus.

The thinnest part of the mould may be oriented in a radial direction away from the axis of rotation.

The moulds may be oriented above the block runner. Alternatively, the moulds may be oriented below the block runner.

The moulds may be removeable.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other. Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38, 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform. The radius of the fan may be measured between the engine centreline and the tip of a fan blade at its leading edge. The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.30, 0.31, 0.32, 0.33, 0.34, 0.35, 0.36, 0.37, 0.38, 0.39 or 0.4 (all values being dimensionless). The fan tip loading may be in an inclusive range bounded by any two of the values in the previous sentence (i.e. the values may form upper or lower bounds), for example in the range of from 0.28 to 0.31, or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, 17, 17.5, 18, 18.5, 19, 19.5 or 20. The bypass ratio may be in an inclusive range bounded by any two of the values in the previous sentence (i.e. the values may form upper or lower bounds), for example in the range of form 12 to 16, 13 to 15, or 13 to 14. The bypass duct may be substantially annular. The bypass duct may be radially outside the core engine. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-}s$, 105 $Nkg^{-}s$, 100 $Nkg^{-}s$, 95 $Nkg^{-}s$, 90 $Nkg^{-}s$, 85 $Nkg^{-}s$ or 80 $Nkg^{-}s$. The specific thrust may be in an inclusive range bounded by any two of the values in the previous sentence (i.e. the values may form upper or lower bounds), for example in the range of from 80 $Nkg^{-}s$ to 100 $Nkg^{-}s$, or 85 $Nkg^{-}s$ to 95 $Nkg^{-}s$. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400 K, 1450 K, 1500 K, 1550 K, 1600 K or 1650 K. The TET at cruise may be in an inclusive range bounded by any two of the values in the previous sentence (i.e. the values may form upper or lower bounds). The maximum TET in use of the engine may be, for example, at least (or on the order of) any of the following: 1700 K, 1750 K, 1800 K, 1850 K, 1900 K, 1950 K or 2000 K. The maximum TET may be in an inclusive range bounded by any two of the values in the previous sentence (i.e. the values may form upper or lower bounds), for example in the range of from 1800 K to 1950 K. The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades may be formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 14, 16, 18, 20, 22, 24 or 26 fan blades.

As used herein, cruise conditions have the conventional meaning and would be readily understood by the skilled person. Thus, for a given gas turbine engine for an aircraft, the skilled person would immediately recognise cruise conditions to mean the operating point of the engine at mid-cruise of a given mission (which may be referred to in the industry as the "economic mission") of an aircraft to which the gas turbine engine is designed to be attached. In this regard, mid-cruise is the point in an aircraft flight cycle at which 50% of the total fuel that is burned between top of climb and start of descent has been burned (which may be approximated by the midpoint—in terms of time and/or distance—between top of climb and start of descent. Cruise conditions thus define an operating point of, the gas turbine engine that provides a thrust that would ensure steady state operation (i.e. maintaining a constant altitude and constant Mach Number) at mid-cruise of an aircraft to which it is designed to be attached, taking into account the number of engines provided to that aircraft. For example where an engine is designed to be attached to an aircraft that has two engines of the same type, at cruise conditions the engine provides half of the total thrust that would be required for steady state operation of that aircraft at mid-cruise.

In other words, for a given gas turbine engine for an aircraft, cruise conditions are defined as the operating point of the engine that provides a specified thrust (required to provide—in combination with any other engines on the aircraft—steady state operation of the aircraft to which it is designed to be attached at a given mid-cruise Mach Number) at the mid-cruise atmospheric conditions (defined by the International Standard Atmosphere according to ISO 2533 at the mid-cruise altitude). For any given gas turbine engine for an aircraft, the mid-cruise thrust, atmospheric conditions and Mach Number are known, and thus the operating point of the engine at cruise conditions is clearly defined.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be part of the cruise condition. For some aircraft, the cruise conditions may be outside these ranges, for example below Mach 0.7 or above Mach 0.9.

Purely by way of example, the cruise conditions may correspond to standard atmospheric conditions (according to the International Standard Atmosphere, ISA) at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to an operating point of the engine that provides a known required thrust level (for example a value in the range of from 30 kN to 35 kN) at a forward Mach number of 0.8 and standard atmospheric conditions (according to the International Standard Atmosphere) at an altitude of 38000 ft (11582 m). Purely by way of further example, the cruise conditions may correspond to an operating point of the engine that provides a known required thrust level (for example a value in the range of from 50 kN to 65 kN) at a forward Mach number of 0.85 and standard atmospheric conditions (according to the International Standard Atmosphere) at an altitude of 35000 ft (10668 m).

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

According to an aspect, there is provided an aircraft comprising a gas turbine engine as described and/or claimed herein. The aircraft according to this aspect is the aircraft for which the gas turbine engine has been designed to be attached. Accordingly, the cruise conditions according to this aspect correspond to the mid-cruise of the aircraft, as defined elsewhere herein.

According to an aspect, there is provided a method of operating a gas turbine engine as described and/or claimed herein. The operation may be at the cruise conditions as defined elsewhere herein (for example in terms of the thrust, atmospheric conditions and Mach Number).

According to an aspect, there is provided a method of operating an aircraft comprising a gas turbine engine as described and/or claimed herein. The operation according to this aspect may include (or may be) operation at the mid-cruise of the aircraft, as defined elsewhere herein.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DISCUSSION OF THE FIGURES

Embodiments will now be described by way of example only, with reference to the Figures, in which.

DETAILED DESCRIPTION OF THE DISCLOSURE

Figure 1:
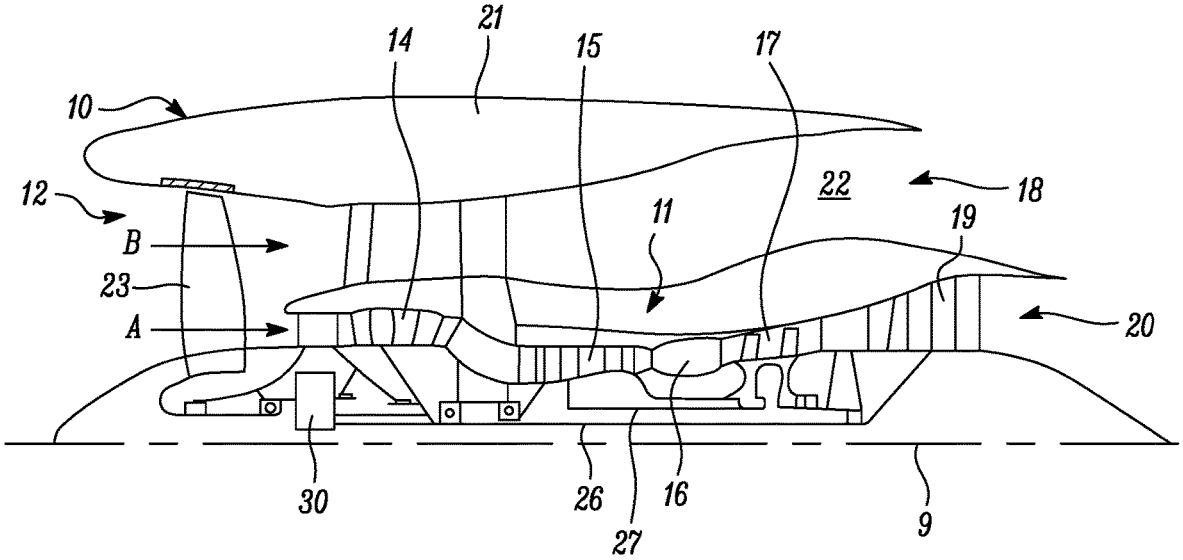
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
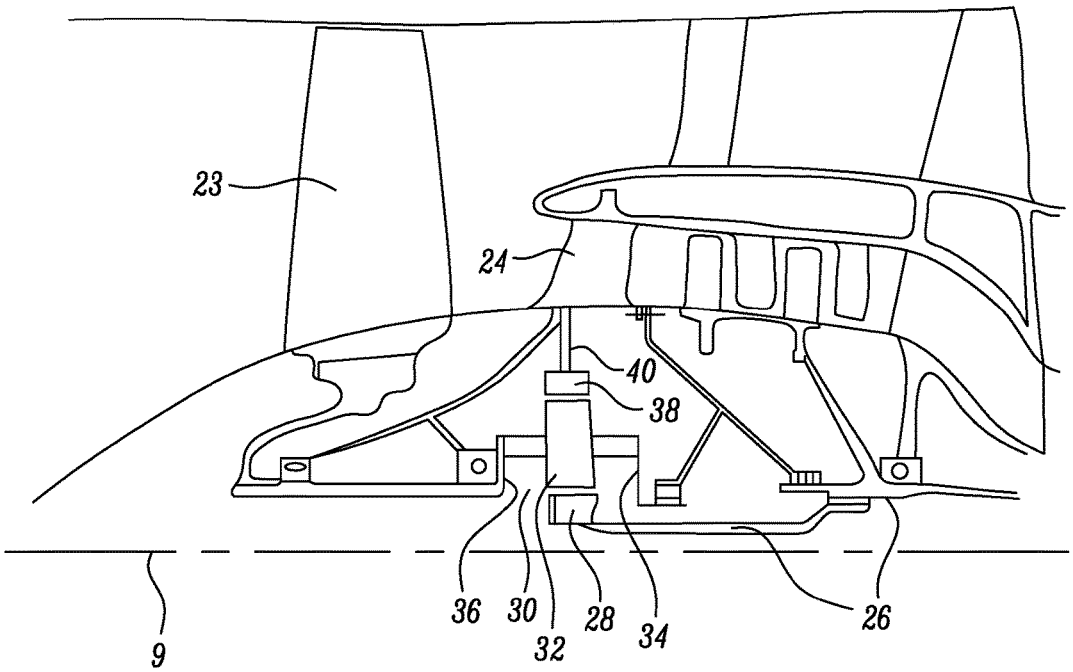
FIG. 2 is a close-up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to process around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
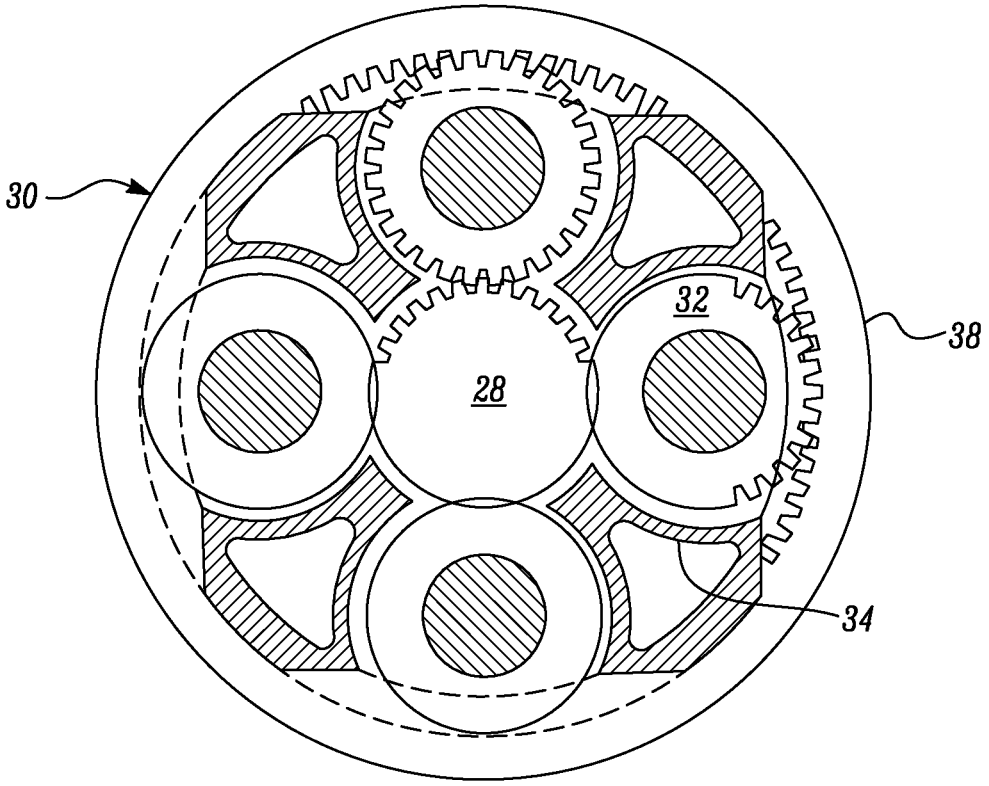
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
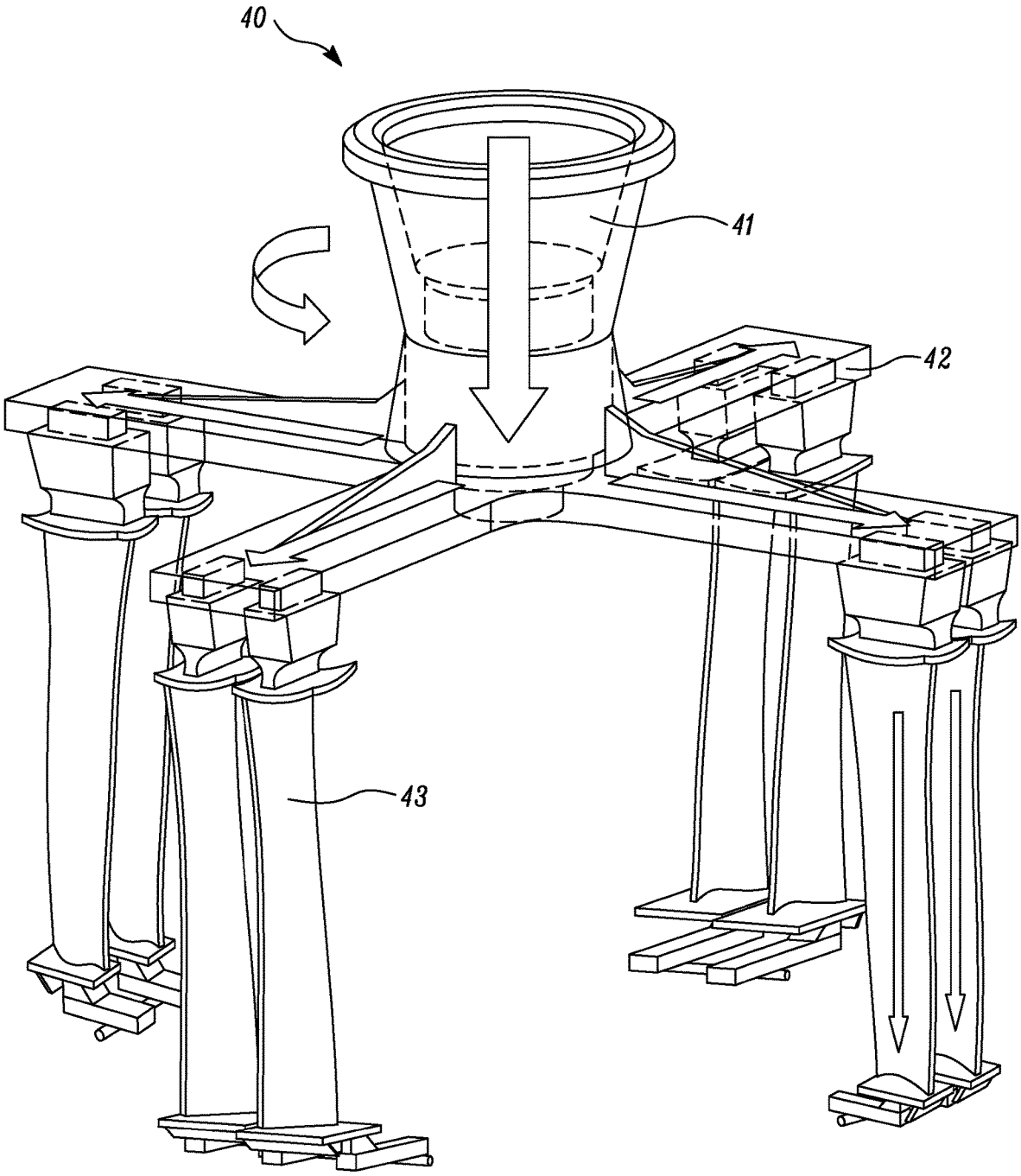
FIG. 4 is a schematic of the casting apparatus of the present disclosure.

FIG. 4 shows a schematic representation of the casting apparatus 40. The casting apparatus comprises an upper portion 41, which receives the molten material. The molten material flows along the path of the arrow. The upper portion forms the centre of the casting apparatus through which runs a central axis, it is about this axis that when in use, the casting apparatus is rotated to generate the required centrifugal force. Thus, in use the central axis becomes the axis of rotation. Connected to the upper portion are a number of block runners 42. The block runners are connected to the upper portion at their proximal ends, whilst at their distal ends they are connected to the moulds 43. Each mould may contain a single or multiple cavities defining the component or components to be cast as well as those features commonly required in shape casting processes to achieve the appropriate material integrity. In particular, elements commonly referred to as feeders by those familiar with the art, or alternatively risers, may be attached to the component. Campbell has set out the purpose of a feeder as being to compensate for the volumetric contraction of the molten material as it solidifies, maintain pressure in the melt and to act as a flow-off for the first metal through the filling system. The runner may also act as a feeder and for any particular component geometry feeders may or may not be required.[1] The moulds are mounted on the block feeder so that they are oriented approximately parallel with the axis of rotation. The moulds may be mounted above or below the block feeders. For example, the moulds may be mounted within 10 degrees of parallel. The moulds may also be mounted within 5 degrees of parallel. The moulds can be removable from the horizontal block feeders. There can be any suitable number of horizontal block feeders. This for example could be 2, 3, 4, 5, 6, 7, 8, 9 or greater. Any suitable number of moulds may be connected to the block feeder. For example, this may be 1, 2, 3, 4, 5 or greater. The moulds may be aligned so that the thinnest part of the mould is oriented in a radial direction away from the axis of rotation.

[1] Campbell J., Complete Casting, pub. Butterworth Heinemann, ISBN-13: 978-1-85617-809-9, pp. 659-696.

In use the molten feed stock is applied into the upper portion 41 of the casting apparatus. For example, feedstock may be melted using induction heating in an appropriate container material or skull melting whereby a resolidified layer forms a solid barrier between a cold crucible and molten charge. Heat for skull melting of the charge can be provided using induction or and electric arc. The feedstock can be formed of any suitable material. This may be pure metals or alloys. Such alloys may include titanium aluminide. The centrifugal casting apparatus is rotated about the axis of rotation. The speed of rotation required to fill the mould will depend on the dimensions of the component and the radial length of the feeder perpendicular to the axis of rotation. A centrifugal force derived from the centrifugal acceleration (g) falling in to the range $150 \leq g \leq 6000\ ms^{-2}$. For example, the centrifugal casting apparatus may be rotated at 50 to 500 rpm. The centrifugal force acting in this apparatus results in the high-quality components produced by this method. This is because the centrifugal motion moves the metal into the mould as quickly as possible to prevent it from solidifying to such a degree as to stop flow (freezing off) before the mould is full. The mould 43 may be pre-heated so as to increase the time before the metal freezes off; thus, allowing the metal to fill the mould, including any thinner sections. For example, the mould may be heated to a temperature of not less than 400° C. and not more than 1200° C. at any location. To prevent the mould from breaking during the casting process, the shell of the mould may be placed within a container and the external form of the mould supported by filling the container (backing) with ceramic grit and then heated. Using such a method enables the mould to reach a uniform or desired non-uniform temperature during any pre-heating process prior to casting. The moulds may be the same as those used for investment casting.

As the casting apparatus on which the assembled mould and any container is rotated the feedstock is passed down a block feeder 42 through centrifugal motion. The block runner may have a rectangular cross-section. However, the shape of the block runner has been found to not be as important as the angle of the runner. This has been found to work best at a range of not more than 10° inclination to the normal to the axis of rotation. In doing so, the molten feedstock flows from the upper portion to the end of the horizontal block feeder through the centrifugal force on the feedstock as the casting apparatus is rotated. Employing this method allows some of the turbulence to be moved to the inner section of the block feeder. Turbulent flow is still present in the material entering the mould resulting from the rotational movement of the feeder and the centrifugal motion. There are a number of small gas bubbles (air under partial pressure or a controlled atmosphere, for example an inert gas at partial pressure) entrained as a consequence of free surface turbulent flow in the runner are transported in to the component. Under the action of the radial pressure gradient in the liquid they are rapidly separated from the liquid alloy. As such, there is also little turbulent entrainment in the actual component. It has been found that through the use of this method that the turbulence remains within the runner/feedblock 42 and the angle between the runner and the mould acts as a quieting feature. This has been found to work best for angle of 90 degrees, However, the mould may also be mounted at an angle between 75-105 degrees. The moulds 43 of the components are mounted approximately parallel to the axis of rotation of the casting apparatus. In this embodiment the casting moulds are presented as being mounted in a vertically downward direction relative to the horizontal block. However, they may equally be positioned in a vertically upward direction relative to the block feeder. This allows the molten feedstock that has been forced to the end of the horizontal block feeder to enter and to fill the mould.

The mould may be oriented in any orientation. However, it has been found that by orienting the thinnest part of the mould of the component in a radial direction opposite to the rotational axis of the mould improves the quality of the cast component. This is because in this way the orientation of the mould ensures that the maximum centrifugal pressure acts at the thinnest part of the component. This has been found to work for thin edges, even for objects such as the trailing edge of blades for use in gas turbine engines.

The moulds may be the same as those used as for static moulds for investment casting. Alternatively, mould can be designed to allow a quiescent fill process to be employed. The use of a quiescent fill process ensures maximum component quality. This casting method may be used to manufacture any suitable component. This could for example be parts for a gas turbine engine such as blades. Alternatively, it could be used to manufacture turbocharger wheels, engine frame connectors and gimbals. The method may be used for any appropriate material to be used in the casting process. In particular it is suitable to materials that can be used for a number of different casting objects and for a number of different applications.

Figure 5:
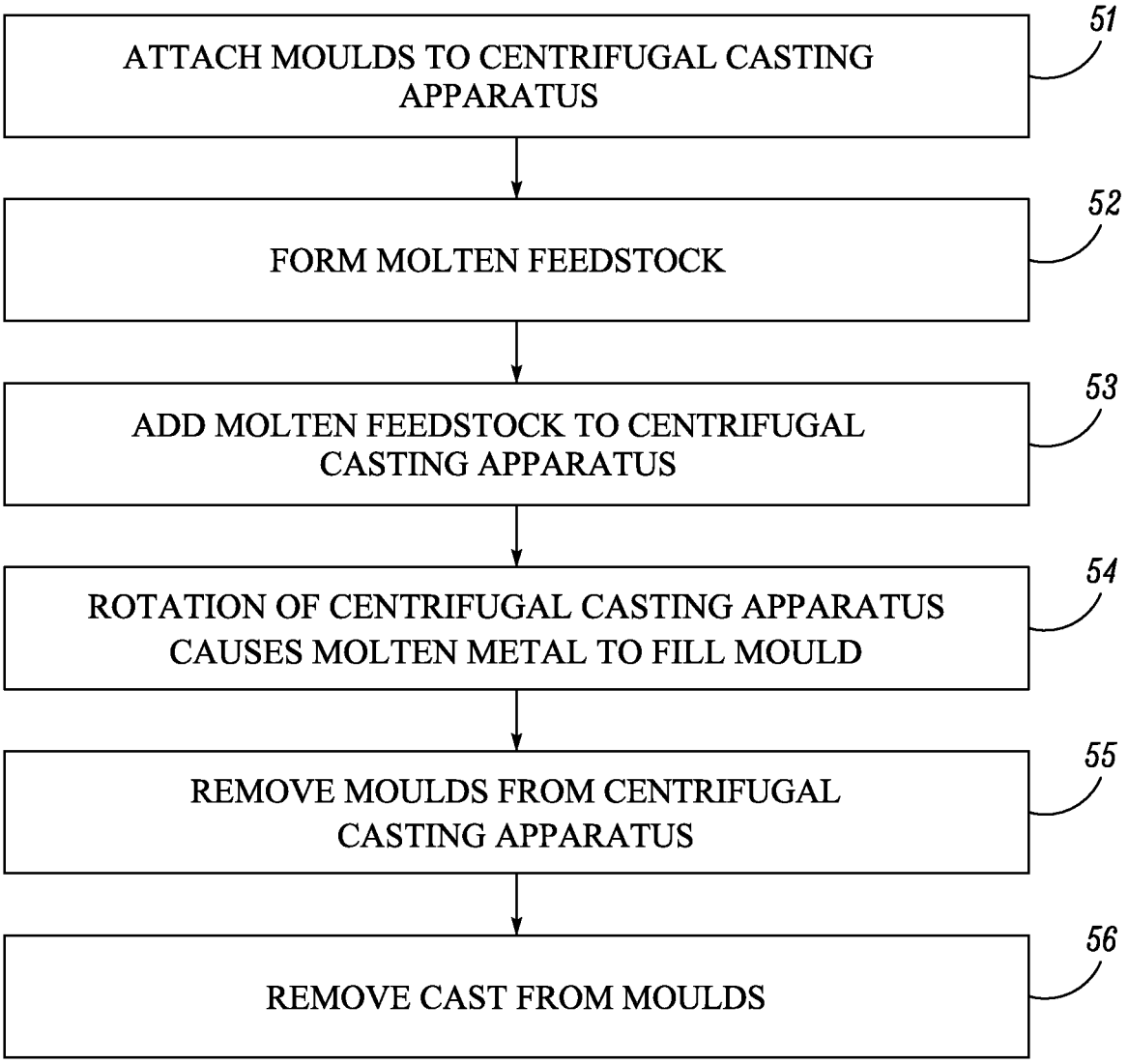
FIG. 5 is a flow chart of an embodiment of the casting process of the disclosure.

FIG. 5 presents an example flow chart of the process disclosed. The moulds are attached to the casting apparatus in step 51. The attached moulds are oriented so that they are parallel to the axis of the rotation of the centrifugal casting apparatus. For example, these may be attached so that they extend below the casting apparatus. The moulds may also be connected so that they are oriented so that the thinnest part of the mould is oriented in a radial direction away from the axis of rotation. The metal compound is melted in step 52 to form a molten feedstock; this may be carried out using a suitable process such as those discussed above. The molten metal is added into the upper portion of the casting apparatus in step 53. Prior to this step the mould may be preheated to an appropriate temperature. The apparatus is rotated at any suitable speed so that the resulting centrifugal force generated through the rotation is enough to move the molten metal to the end of the block feeder of the casting apparatus. The metal fills the mould in step 54 and is allowed to cool and solidify. The moulds are then removed from the casting apparatus in step 55. The moulds can then be separated from the cast components in step 56.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of casting a component comprising:

attaching a mould to a centrifugal casting apparatus, such that the mould is oriented substantially parallel to an axis of rotation of the centrifugal casting apparatus, and applying a molten feedstock through (i) an upper portion of the centrifugal casting apparatus, a central rotational axis of the upper portion coinciding with the axis of rotation of the centrifugal casting apparatus, and (ii) a block runner mounted substantially perpendicular to the axis of rotation to control and contain a turbulence within the molten feedstock, wherein the molten feedstock is a titanium aluminide alloy material, a thinnest part of the mould is oriented in a radial direction away from the axis of rotation, the thinnest part of the mould is a radial outermost part of the mould, and the component is a blade.

2. The method of casting as claimed in claim 1, wherein the mould is pre-heated prior to the casting process.

3. The method of casting as claimed in claim 2, wherein the mould is heated to a temperature between 400 and 900° C.

4. The method of casting as claimed in claim 1, wherein the mould is an investment shell.

5. The method of casting as claimed in claim 4, wherein the investment shell is backed with a ceramic grit.

6. The method of casting as claimed in claim 1, wherein the centrifugal casting apparatus is rotated at 200 to 400 rpm.

7. The method of casting as claimed in claim 1, wherein the mould is mounted perpendicular to the block runner to prevent the turbulence.

8. The method of casting as claimed in claim 1, wherein the step of applying the molten feedstock includes quiescent filling the molten feedstock into the mould via an angle formed between the block runner and the mould.

9. The method of casting as claimed in claim 1, wherein the blade is blade for a gas turbine engine.

10. A centrifugal casting apparatus for casting a component, the apparatus comprising:

an upper portion into which molten material is poured, the upper portion having a central rotational axis about which the apparatus is rotated; and at least one block runner connected to the upper portion at a proximal end of the at least one block runner and to at least one mould at a distal end of the at least one block runner, the at least one block runner being mounted substantially perpendicular to the axis of rotation, wherein the at least one mould is oriented substantially parallel to the axis of rotation of the centrifugal casting apparatus, the molten feedstock is a titanium aluminide alloy material, a thinnest part of the mould is oriented in a radial direction away from the axis of rotation, the thinnest part of the mould is a radial outermost part of the mould, and the component is a blade.

11. The centrifugal casting apparatus of claim 10, wherein the at least one mould is removeable.

* * * * *